United States Patent [19]

Lindenmeier et al.

[11] Patent Number: 4,602,260

[45] Date of Patent: Jul. 22, 1986

[54] WINDSHIELD ANTENNA

[75] Inventors: Heinz Lindenmeier, Planegg; Gerhard Flachenecker, Ottobrunn; Jochen Hopf, Haar, all of Fed. Rep. of Germany

[73] Assignee: Hans Kolbe & Co., Bad Salzdetfurth, Fed. Rep. of Germany

[21] Appl. No.: 604,312

[22] Filed: Apr. 26, 1984

[30] Foreign Application Priority Data

Apr. 28, 1983 [DE] Fed. Rep. of Germany ..... 3315458

[51] Int. Cl.[4] ..... H01Q 1/32

[52] U.S. Cl. ..... 343/701; 343/713

[58] Field of Search ..... 343/701, 712, 713; 455/269, 274

[56] References Cited

U.S. PATENT DOCUMENTS 4,527,164 7/1985 Cestaro et al. ..... 343/713

FOREIGN PATENT DOCUMENTS

| | | |
|---|---|---|
| 7527621 | 5/1976 | Fed. Rep. of Germany . |
| 2021331 | 4/1977 | Fed. Rep. of Germany . |
| 7808489 | 10/1978 | Fed. Rep. of Germany . |
| 2554829 | 8/1981 | Fed. Rep. of Germany . |
| 2554824 | 8/1981 | Fed. Rep. of Germany . |
| 1919749 | 5/1982 | Fed. Rep. of Germany . |
| 2166898 | 8/1982 | Fed. Rep. of Germany . |
| 2115657 | 12/1983 | Fed. Rep. of Germany . |

*Primary Examiner*—Eli Lieberman

*Attorney, Agent, or Firm*—Michael J. Striker

[57] ABSTRACT

An active windshield antenna has a first conductor extending parallel to a metal frame to the vertical line of symmetry of the latter, a second conductor extending in a bending point from said first conductor along the symmetry line, an amplifier has separate transmission paths for a low frequent low medium short wave region and ultra short wave region, the transmission path of the long medium short wave region at an inlet of the low medium short wave amplifier has a high input impedance, and the input impedance of the total amplifier in the low medium short frequency region is high.

15 Claims, 4 Drawing Figures

WINDSHIELD ANTENNA

BACKGROUND OF THE INVENTION

The present invention relates to active windshield antenna for power vehicles for ultra short and long medium short radio frequency. More particularly it relates to a windshield antenna which has a metallic frame of a windshield of a power vehicle, an antenna wire, and an antenna amplifier.

Windshield antennas of the above-mentioned general type are known in the art. A known windshield antenna has a metallic frame of a windshield of a power vehicle, an antenna wire, an antenna amplifier with two input terminals and an output conduit, wherein the antenna amplifier is arranged in the vicinity of the metallic frame and the antenna wire is arranged on or in the windshield. The first input terminal of the antenna amplifier is connected with a maximum short connecting conductor with one end of the antenna wire, whereas the second input terminal of the antenna amplifier is connected with the conductive frame which surrounds the windshield and the output conduit of the amplifier leads to a receiver.

With active windshield antennas it is known to receive all the wave regions (long, medium, short and ultra short waves), as with the standard antennas in power vehicles. It is advantageous here that by the integration of the antenna into the vehicle body such antennas satisfy much better than the standard rod antennas the specific requirements applied to the vehicle, such as mechanical rigidity, high service life, simple mounting, elimination of unnecessary air whirling. Active windshield antennas with the above described properties are disclosed, for example, in the German GM application G 7,808,489.6. It has been shown that a power vehicle antenna which is proposed here provides for extremely unsatisfactory receiving power in the event of vertically or circularly polarized waves of the polarization types frequently used for example in the United States for the ultra short radio broadcasting, whereas the receiving power in the ultra short region with horizontal polarization and in the long medium short region of the standard antenna is at least equivalent. Also, for an unobjectionable functioning of the antenna the predetermined position of the antenna amplifier is disadvantageous. A modification disclosed in the GM in the change of the terminal location leads especially in the ultra short wave region to worsening of the reception properties.

SUMMARY OF THE INVENTION

Accordingly, it is an object of the present invention to provide an active windshield antenna which avoids the disadvantages of the prior art.

More particularly, it is an object of the present invention to provide an active windshield antenna whose receiving power possesses good reception properties both in the event of horizontally as well as vertically and circularly polarized ultra short wave receiving fields and in the vertically polarized long medium short region, and which also makes possible free selection of the mounting point for the amplifier in the vicinity of the metal frame in the sense of vehicle-specific points of view.

In keeping with these objects and with others which will become apparent hereinafter, one feature of the present invention resides, briefly stated, in an antenna in which an antenna wire is used with a first conductor extending parallel to a frame to a vertical line of symmetry, and a second conductor extending from a bending point on the line of symmetry along the latter, an amplifier has separate transmission paths for low frequency long medium short region and ultra short wave region (FM-range), and a transmission path of the long medium short wave region (AM-range) at an input of a low medium short wave amplifier path has high input impedance whereas the input impedance of the amplifier in the long medium short frequency region is high.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

A windshield antenna in accordance with the present invention possesses a special advantage both in the event of horizontal as well as vertical and circular polarization to provide advantageous reception condition in the ultra short wave region. In contrast to the known antennas disclosed for example in the GM G 7,808,498.6 and the GM G 7,527,621.0 which during transition from the horizontal polarization to the vertical polarization is inferior to a vertical reference antenna, the antenna according to the present invention provides good results for all polarization types.

In many cases especially with antennas integrated in the vehicle body such as with the windshield antennas, the mounting location for the antenna terminals and the amplifier is subject to the vehicle-specific restraints. These restraints frequently are produced by the mounting sequence during the manufacture of the power vehicle and also by the requirements of the exchangeability and subsequent mountability of the antenna amplifier. With an antenna amplifier and a conductor configuration in accordance with the present invention, the attainable receiving properties are nearly independent of the predetermined mounting location. Also an adjustment of the wire length in the sense of its correspondence to the actual vehicle body or windshield opening is of no problem with the given conductor configuration.

Figure 1:
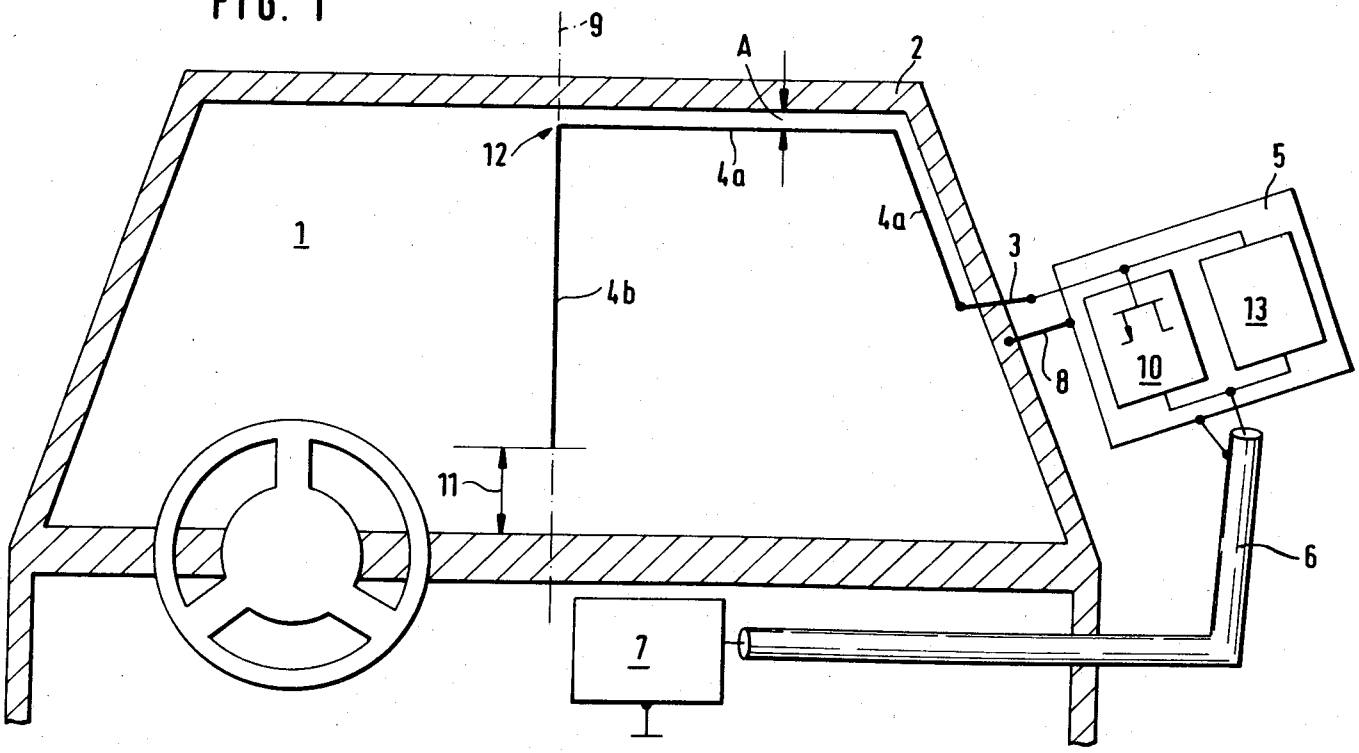
FIG. 1 is a view showing an active windshield antenna for all polarization types in accordance with the present invention.

FIG. 1 shows a front window of a vehicle as seen from a passenger compartment. An antenna amplifier 5 is arranged in the vicinity of a metal frame and connected with its mass point with the metal frame of the windshield by a connection 8. The antenna amplifier has at its input a branch of a transmission path for signal portions from the ultra short wave frequency region and the long medium short wave frequency region. Such a signal branching is known from the patent applications P 2,115,657, P 2,166,898, or P 1,919,749. The transmission path for the long medium short frequency region includes an amplifier with high input impedance such as disclosed for example in the patent applications P 2,021,331, P 2,554,828 or P 2,554,829. It is essential for sensitivity reasons that the circuit for the branching of the signal does not load with low impedance the input impedance of the long medium short wave amplifier in the low medium short wave frequency region, so that the input impedance of the whole amplifier 5 in the low medium short wave frequency region is high.

The cooperation of the conductor configuration provided by conductors 4*a* and 4*b* with a low medium short wave amplifier 10 is illustrated hereinbelow. The conductor 4*b* provides an essential part for the reception. For the purpose of the good reception in the long medium and short wave region, the conductor 4*b* must not be selected too short and must use a maximum possible part of the available windshield height. Though the reception field strengh in the lower part of the conductor 4*b* is directed opposite to the field strength in the upper part, from the point of view of the low medium short wave reception the whole conductor length is preferable due to the therewith increased capacity.

For the long medium short reception it is sufficient in many cases to arrange the amplifier on the metal frame 2 at its line of symmetry 9. Such a mounting point is, however, frequently not possible on the vehicle-specific reasons. For overspan the distance between a bending point 12 on the line of symmetry 9 and the predetermined mounting location of the amplifier according to the state of the art one could think to use, a conventional coaxial conductor. Such a conductor possesses, however, the disadvantage of a high parallel capacity which leads to a loss in sensitivity. The arrangement of the conductor 4*a* in accordance with the present invention possesses a decisive advantage of a relatively small capacity in connection with an additional contribution to the reception. This contribution is based on a high concentration of the electric field lines in the vicinity of the metal frame which in the event of small distances of the conductors 4*a* from the metal frame 2 acts for a significant improvement of the reception. It is quite possible to keep a distance A of this conductor from the metal frame so small that it does not affect the visibility of a driver or a side driver and the design of the windshield. The distances substantially below 10 mm between the conductor 4*a* and the metal frame are in general to be avoided.

The operation of an active windshield antenna in accordance with the present invention for the reception in the ultra short wave region in accordance with FIG. 1 is explained hereinbelow. It is known that a windshield opening 1 surrounded by the conductor frame 2 can approximately be looked at as a slot radiator which can be excited in an optimal manner by a wave with an electrical field strength vector oriented in direction of the line of symmetry 9. In the ultra short wave band a resonance-like magnification of the field strength takes place along the line 9 when the width of the windshield opening substantially corresponds to half wave length as is the case in modern conventional power vehicles. In the event of both horizontally as well as vertically and circularly polarized waves field components in direction of the line of symmetry 9 are available because of the inclined window glass in the vehicle, which leads to the window frame resonance.

A wire structure such as a conductor 4*b* is strongly coupled with the reception field. The connection of the conductor 4*a*, to the contrary, can be changed by means of the distance A. Small distances between the conductor 4*a* and the frame 2 lead to a low signal pick up from the field and great distances A lead to a high signal pick up from the field. By means of the distance A also the ratio of the contribution to the reception of the conductors 4*a* and 4*b* in the ultra short wave region can be changed.

Though a maximization of the ultra short wave signal power available at the end of the conductor 4*a* is associated in many cases with the selection of the maximum for safety reasons possible distance A of approximately 7 cm to the frame 2, in practice the distance A can be selected substantially smaller since thereby an attractive antenna design is obtained and the visibility through the windshield is less affected.

Distances down to approximately 10 mm from the frame 2 can be tolerated, since the signal pick up from the field as a whole through the conductor 4*b* is high enough and in connection with a noise-optimized active ultra short wave signal path 13 in the amplifier 5, the produced signal-to-noise ratio is superior compared to the standard system with the standard antenna.

By variation of a distance 11 between the end of the conductor 4*b* and the frame 2, the available output power of the structure can be optimized. Frequently, the maximum possible length is found to be the optimal length for all polarizations. For preventing a high frequency short-circuiting at the end of the conductor 4*b* with the frame 2, the distance 11 must not be less than 2 mm.

For the mounting point of the amplifier selected from the vehicle-specific considerations, the optimal distance 11 between the end of the conductor 4*b* and the frame must be defined so that for different distances 11 by long measuring travels with statistic travel paths, the average antenna output voltage of the structure under test obtained at the input resistance of the measuring receiver is evaluated in comparison with the average output voltage of the reference antenna. From this voltage of a not power-matched load resistance, after measurement of the impedance of the wire structure, the available average output power is computed. This is the power which could be obtained in the event of a power-matched load.

The optimal distance 11 is found when the available signal power is maximum, wherein the value of the impedance of the wire structure is approximately insignificant, since inside the transmission path for the ultra short wave frequency region 13 in the antenna amplifier 5 loss free transformation circuits can be used. Such transformation circuits are advantageously constructed so that noise matching for the input transistor is obtained when an active element is used in the transmission path 13 such as fieldeffecttransistor or a bipolar transistor, or the power matching is provided at the wave impedance of the connecting cable 6 to the receiver 7 when the transmission path 13 is designed as passive.

The transmission path 13 for the ultra short wave frequency region may be passive. However this is only advantageous if the obtainable signal noise ratio in combination with the receiver with the windshield antenna structure is at least equal to the standard rod antenna.

As a rule, it is required to guarantee via a noise-matched amplifier stage a satisfactory field strength sensitivity.

Figure 2:
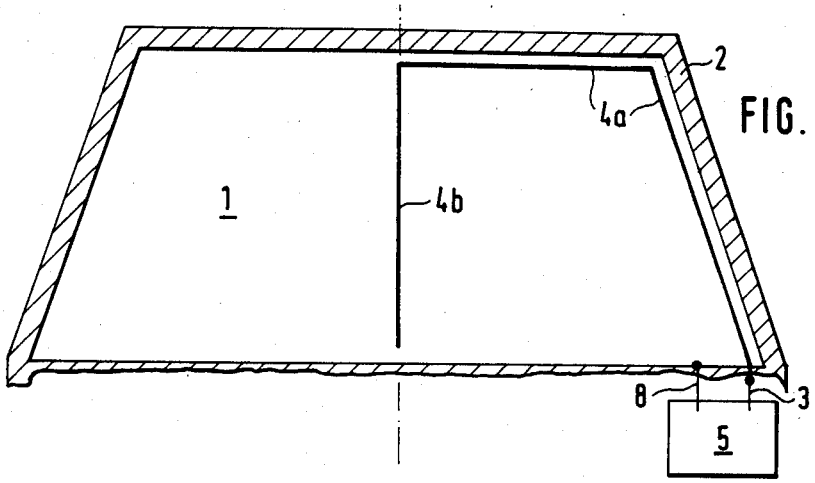
FIG. 2 is a view showing the inventive antenna with an amplifier mounted in a right lower corner.

FIG. 2 shows an advantageous embodiment of the invention in which the antenna amplifier 5 and the antenna terminal are located in the vicinity of the right lower corner of the metal frame, the bending point 12 is located in the vicinity of the upper horizontal part of the metal frame, and the conductor 4*a* extends parallel to the right and to the horizontal upper part of the metal frame.

In this example, the amplifier is mounted in the region of the instrument board which is a region with a frequently sufficient space and is readily accessible for mounting of an antenna or a change of the antenna amplifier. This mounting location is also advantageous since only a relatively short connecting cable for the receiver is needed.

Figure 4:
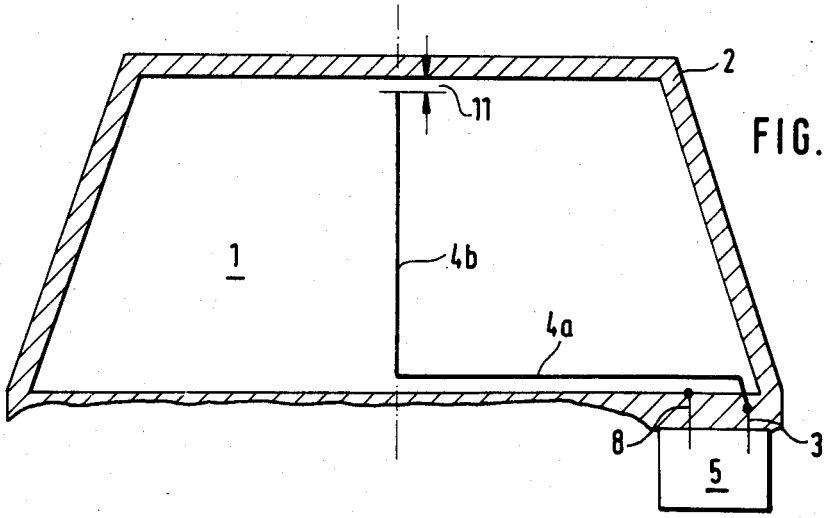
FIG. 4 is a view showing the inventive antenna with an amplifier mounted in a right lower corner and with a minimal wire length.

FIG. 4 shows an embodiment of the invention with the same mounting point for the amplifier as in FIG. 2. However, here there is a minimized wire length on the windshield and a simple geometry for the conductors, as compared with the structure of FIG. 2, with only one bending point. This provides for cost advantages in the manufacture of the antenna. However, there is a danger of an interference pickup from the motor space onto the antenna structure in the embodiment of FIG. 4, because of the proximity of the conductor 4*a* to the interference sources, such as the ignition. Therefore this structure can be used advantageously only for vehicles with satisfactory interference suppression.

Figure 3:
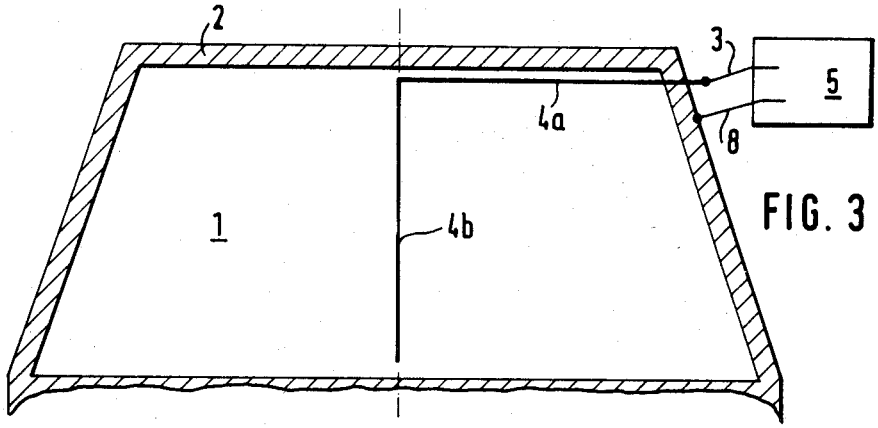
FIG. 3 is a view showing the inventive antenna with an amplifier mounted in an upper right region.

FIG. 3 shows also an advantageous arrangement of the amplifier in the right upper corner of the metal frame, which is a region in which frequency in the right cross bar or under the vehicle skylight a sufficient space for the antenna amplifier is available. The connecting cable can frequently be simply guided downwardly under the synthetic plastic hood which coats the metallic cross bar. The wire structure has the same advantages as the structure of FIG. 4, namely the advantage in the simplicity and cost favorable manufacture. However, as compared with the structure of FIG. 4, it is less susceptible to the reception of motor interference.

It will be understood that each of the elements described above, or two or more together, may also find a useful application in other types of constructions differing from the types described above.

While the invention has been illustrated and described as embodied in an active windshield pane antenna for all polarization types, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An active windshield antenna for a power vehicle for ultra short wave and long medium short wave radio reception, comprising a metallic frame associated with the windshield pane of a power vehicle and having a substantially vertical line of symmetry and dividing the windshield into two similar sections; an antenna wire having two ends, said antenna wire being confined to one only of said similar sections; and an antenna amplifier having two input terminals being arranged adjacent to said metallic frame, said input terminals including a first input terminal connected with one of said ends of said antenna wire and a second input terminal connected with said metallic frame and an outlet conduit leading from said amplifier to a receiver, said antenna wire including a first conductor which extends parallel to said frame up to said substantially vertical line of symmetry and a second conductor extending from said first conductor in a bending point and along said line of symmetry, said amplifier being formed so that for the low frequency low medium short wave region and the ultra short wave region separate transmission paths are obtained, whereas the transmission path of the low medium short wave region at its input has a high input impedance and the input impedance of said amplifier in the low medium short frequency region is high-impedance.

2. An active windshield antenna as defined in claim 1, wherein said frame has at least one horizontal frame part opposite to said first conductor, said second conductor of said antenna wire having an end facing away from said first conductor and spaced from said horizontal frame part by such a distance that with respect to the signal power available at a connecting end of said first conductor in the ultra short region both for horizontal as well as for vertical and circular polarized waves a maximum is adjusted.

3. An active windshield antenna as defined in claim 1, wherein said frame has a horizontal frame part opposite to said first conductor, said second conductor extending along said line of symmetry from said bending point approximately up to said horizontal frame part and ends at a distance of at least 2 mm from the latter.

4. An active windshield antenna as defined in claim 1, wherein said first conductor of said antenna wire is spaced from said frame at a distance of between 1 cm and 7 cm.

5. An active windshield pane antenna as defined in claim 4, wherein said first conductor of said antenna wire is spaced from said frame at a minimum distance, but sufficient for not considerably worsening the long medium short wave reception.

6. An active windshield antenna as defined in claim 1, wherein said wire is connected with said antenna amplifier at a connecting location, said first conductor of said antenna wire being spaced from said frame at a distance of between 1 cm and 7 cm and selected so that in the ultra short wave region at said connecting location between said wire and said antenna amplifier an available signal power in the ultra short region is maximal.

7. An active windshield antenna as defined in claim 1, wherein said antenna wire is connected with said amplifier in a connecting location, said metal frame having a right lower corner and an upper horizontal part, said amplifier and said connecting location being arranged in said right lower corner of said metal frame, said bending point between said first conductor and said second conductor of said antenna wire being located in the vicinity of said upper horizontal part of said metal frame, and said first conductor extending parallel to the right vertical and to said horizontal upper part of said metal frame.

8. An active windshield antenna as defined in claim 1, wherein said antenna wire is connected with said amplifier in a connecting location, said metal frame having a right upper corner and an upper horizontal part, said amplifier and said connecting location being located in the vicinity of said right upper corner of said metal frame, said bending point between said first conductor and said second conductor of said antenna wire being located in the vicinity of the upper horizontal part of said metal frame, and said first conductor extending parallel to said horizontal upper part of said metal frame.

9. An active windshield antenna as defined in claim 1, wherein said antenna wire is connected with said amplifier in a connecting location, said metal frame having a right lower corner and a lower horizontal part, said amplifier and said connecting location being located in the vicinity of said right lower corner of said metal frame, said bending point between said first conductor and said second conductor being located in the vicinity of said lower horizontal part of said metal frame, and said first conductor extending parallel to said horizontal lower part of said metal frame.

10. An active windshield antenna as defined in claim 1, wherein said transmission path for the ultra short wave region has at least one amplifying active three terminal device which with the aid of a loss free network being connected between said antenna wire and the front end of said active device is matched to the impedance of said antenna wire in said first conductor so that the signal-to-noise ratio is optimum.

11. An active windshield antenna as defined in claim 1, wherein said transmission path for the ultra short wave region consists a loss free matching network and a power match exists between the connecting end of said first conductor and said outlet conduit of said amplifier.

12. An active windshield antenna as defined in claim 1, wherein said antenna wire is arranged so that it is placed on the windshield.

13. An active windshield antenna as defined in claim 1, wherein said antenna wire is arranged so that it is placed inside the windshield.

14. An active windshield antenna as defined in claim 1; and further comprising a connecting conduit which connects said first input terminal of said antenna amplifier with said end of said antenna wire over a maximum short path.

15. An active windshield antenna as defined in claim 1, wherein said frame is formed so that it surrounds the windshield.

* * * * *